United States Patent [19]

Ayres

[11] Patent Number: 4,896,726

[45] **Date of Patent: * Jan. 30, 1990**

[54] SLIP STREAM DEVICE

[76] Inventor: Robert N. Ayres, 7009 Meadowview Loop W., Lake Charles, La. 70605

[ * ] Notice: The portion of the term of this patent subsequent to Jan. 10, 2006 has been disclaimed.

[21] Appl. No.: 295,850

[22] Filed: Jan. 10, 1989

Related U.S. Application Data

[63] Continuation-in-part of Ser. No. 71,020, Jul. 7, 1987, Pat. No. 4,796,697.

[51] Int. Cl.[4] ..... E21B 37/08

[52] U.S. Cl. ..... 166/312; 166/902; 166/90; 175/49

[58] Field of Search ..... 166/310, 311, 312, 75.1, 166/90, 92, 902; 175/49

[56] References Cited

U.S. PATENT DOCUMENTS

| | | | |
|---|---|---|---|
| 1,645,686 | 10/1927 | Brady | 166/75.1 X |
| 1,758,376 | 5/1930 | Sawyer | 166/312 |
| 2,167,393 | 7/1939 | Muncy | 175/49 |
| 2,801,697 | 8/1957 | Rohrback | 166/902 X |
| 4,436,148 | 3/1984 | Maxwell | 166/902 X |

*Primary Examiner*—William P. Neuder
*Attorney, Agent, or Firm*—Lowe, Price, LeBlanc, Becker & Shur

[57] ABSTRACT

A device and method for continuously adding chemicals to a producing oil well to prevent the formation of paraffins, emulsions, scale and to prevent corrosion is described. The device includes an above ground mixing chamber having an inlet and an outlet. A portion of the flow of production oil is diverted from the production tubing to the inlet. Chemical are added in the mixing chamber, and the mixture is then flushed down through the well casing to the bottom of the well to be pumped up the production tubing. The device includes a sight glass on the mixing chamber to visually observe the mixture, a bleed valve on the mixing chamber to remove samples and the like, and a pressure gauge for registering the internal pressure within the chamber. A line check valve is provided at the inlet to close the inlet in the case of excessive back pressure to prevent a flow of chemicals back through the inlet, and a choke with a predetermined orifice is provided at the outlet to regulate the flow rate therethrough.

13 Claims, 4 Drawing Sheets

20
18
30
22
36
24
28
26
16
10
12
14

SLIP STREAM DEVICE

CROSS REFERENCE TO RELATED APPLICATION

This application is a continuation-in-part of my U.S. patent application Ser. No. 071,020, filed July 7, 1987, now U.S. Pat. No. 4,796,697, issued Jan. 10, 1989.

BACKGROUND OF THE INVENTION

This invention relates to a device and method for efficiently and reliably adding chemicals to a producing oil well to eliminate undesirable conditions such as paraffin build up, corrosion, and the like.

In general, a producing oil well is subject to emulsion or paraffin build up, the build up of scale within the tubing, and corrosion. Without treatment these conditions can reduce or stop production.

In a typical oil well, oil is pumped upwardly through a central tube by the down hole pump and the tube is surrounded by a casing. Gas typically travels upwardly through the casing. Oil and gas enter the tubing and casing through perforations. Perforations are subject to plugging and the pump and tubing are subject to the build up of scale and damage by corrosion.

In the case of paraffin build up, it is a common industry practice to periodically treat the well with hot oil, trucked to the site. The truck pumps hot oil down the casing and back up the tubing. This process removes deposits of paraffin by melting the paraffin. A triplex injection truck is also used to treat down hole corrosion and scale problems. The truck batch treats the well by pumping chemicals down the casing and back up the tubing using typically three or four barrels of water to flush the chemicals down the casing. The truck must inject several gallons of chemicals per treatment to have the desired effect.

Clearly, it would be preferable to provide a continuous method for treating the well on site without the necessity of trucking in either hot oil or chemicals, on a periodic basis. Continuous treatment then would eliminate build up of emulsions or paraffin because they would never form and provide for uninterrupted production. The cost of trucking also then would be eliminated as well as the need for a periodic shut down of production for well treatment.

In U.S. Pat. No. 1,645,686 there is described a device for injecting chemicals into a well. The device includes a reservoir and a collection tank and gas from the well is used to provide head pressure within the reservoir so that the chemicals will flow into the well by gravity. In U.S. Pat. No. 1,758,376 chemicals are injected into the casing down a separate pipe and head pressure is provided by a pump. Neither patent however has a provision for eliminating clogging, and both involve substantial equipment such as additional tanks or an extra run of tubing extending down the casing.

SUMMARY OF THE INVENTION

The device of this invention solves the aforementioned problems by continuously diverting a stream of production oil, admixing chemicals therewith and returning the mixture down the casing. The mixing chamber of this invention preferably includes a device for regulating the flow rate therethrough and an internal check valve which operates to prevent the back up of chemicals into the production stream in the case of clogging. When the chemical "slip stream" mixture traveling down the casing encounters an obstruction, pressure, as registered on a gauge at the mixing chamber, will build therewithin. When the pressure builds, the check valve will close the port admitting production oil to the mixing chamber to prevent the back up of chemicals thereinto. The chemicals then are pumped directly into the casing until the pressure of the chemicals therewithin opens the obstruction. When pressure decreases the check valve automatically opens, and normal operation resumes. The device of this invention also includes a sight glass for observing the mixture entering the casing.

Accordingly, it is an object of this invention to provide a device for continuously adding chemicals to a production well for eliminating paraffin, emulsions, scale, corrosion and the like without interrupting production.

It is another object of this invention to provide a slip stream device for diverting a stream of production oil from the well head, adding chemicals thereto, and circulating the mixture downwardly through the casing to eliminate clogging of the well an similar problems.

It is yet another object of this invention to provide a device consisting of a mixing chamber with a pressure gauge and site glass, a chemical inlet, and an inlet for a diverted portion of oil well production wherein the chemicals are mixed with the oil and directed downwardly into the casing for recirculation down the casing and up the production tubing to treat the installation eliminating build up of paraffin, scale and the like on a continuous basis.

DESCRIPTION OF THE DRAWINGS

This and other objects will become readily apparent with reference to the drawings and following description wherein.

DETAILED DESCRIPTION OF THE INVENTION

Figure 1:
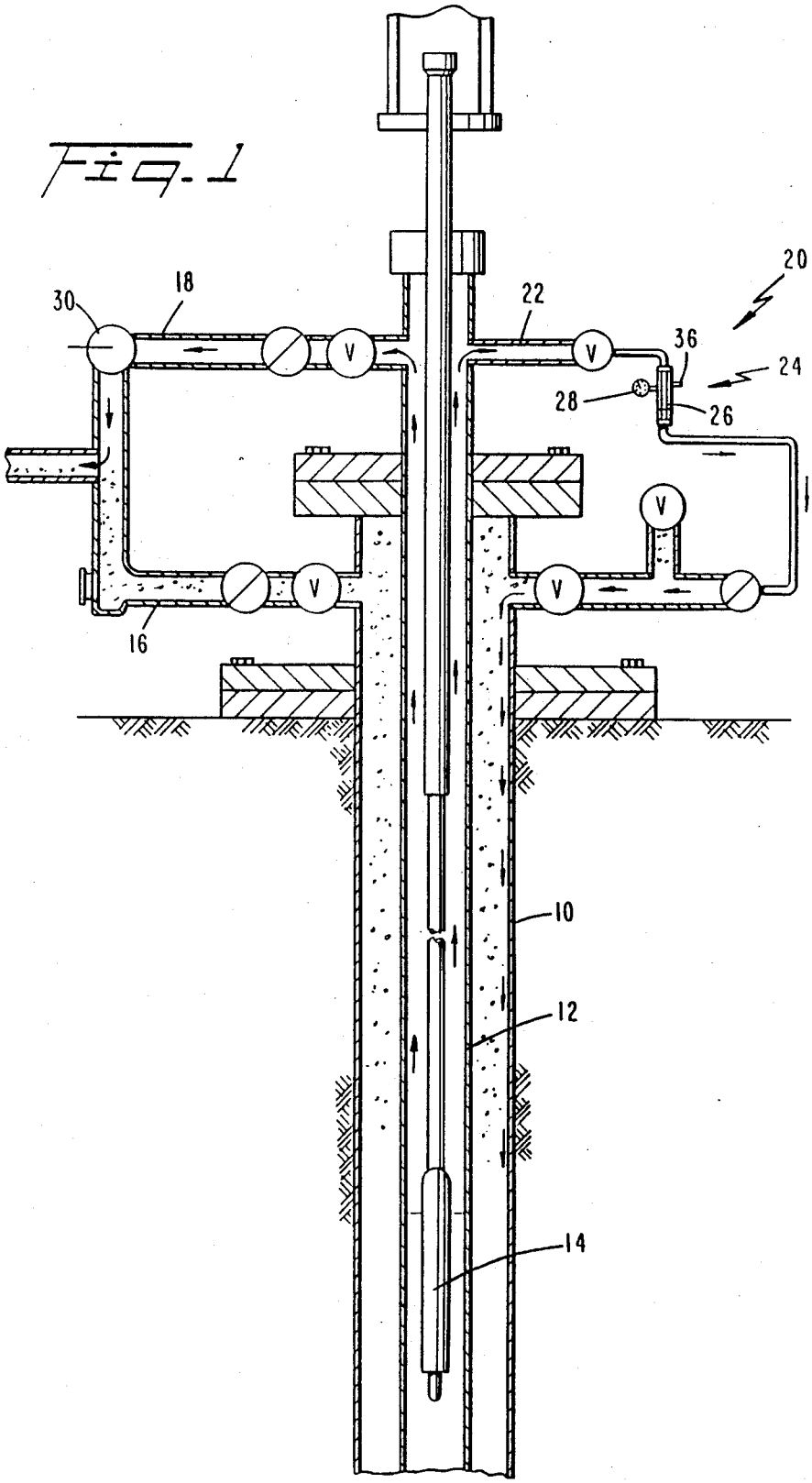
FIG. 1 is a simplified fragmentary view of an oil well using the slip stream device of this invention in cross-section.

With attention to the drawings and to FIG. 1 in particular, there is depicted a typical well installation consisting of an outer casing 10 and an inner tube 12. A down hole pump 14 pumps production crude oil upwardly through tube 12 while gas in the well travels upwardly through the casing 10. Gas is removed from the casing via conduit 16 and oil is removed via conduit 18.

This invention, as will be obvious to those skilled in the art is not limited to the type of well installation but may be adapted to different types of installations. Typically the oil and gas enter the casing 10 via perforations therein (not shown). The oil to be pumped upwardly in the tubing 12 also typically enters via perforations (not shown).

The device of this invention 20 includes a bypass conduit 22 which admits a portion of the production oil from tubing 12. Chemicals (not shown) are added to the oil stream at a mixing chamber 24, and the mixture is circulated into the casing 10 where the chemicals are flushed downwardly by the oil stream to the bottom of the well installation and are then returned upwardly by pump 14 through tubing 12. In this way, chemicals can be continuously added to the well to prevent build up of emulsions, paraffin, scale, and the like.

Mixing chamber 24 mounts a sight glass 26 for visual observation of the mixture and a pressure gauge 28.

Typically it is desired to have a reading at pressure gauge 28 of 10 to 15 pounds per square inch pressure greater than the pressure within casing 10. While it is not necessary in all wells, if the pressure within casing 10 is greater than the pressure within tubing 12 it will be necessary to utilize a back pressure valve 30 to increase the pressure in the flow through conduit 22 so that chemicals added will flow downwardly through casing 10 and through the upward flow of natural gas. Back pressure valve 30 then is not a requirement in situations where the pressure within tubing 12 exceeds the gas pressure within casing 10.

Figure 2:
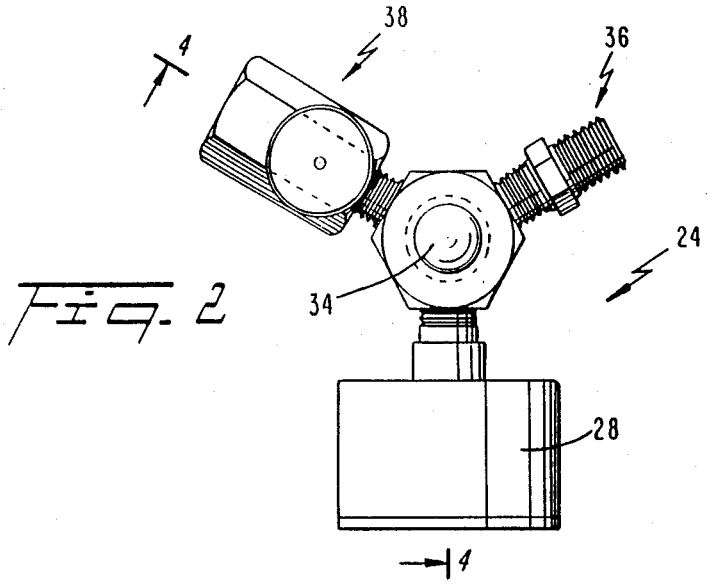
FIG. 2 is a top view of the mixing device of this invention.
Figure 3:
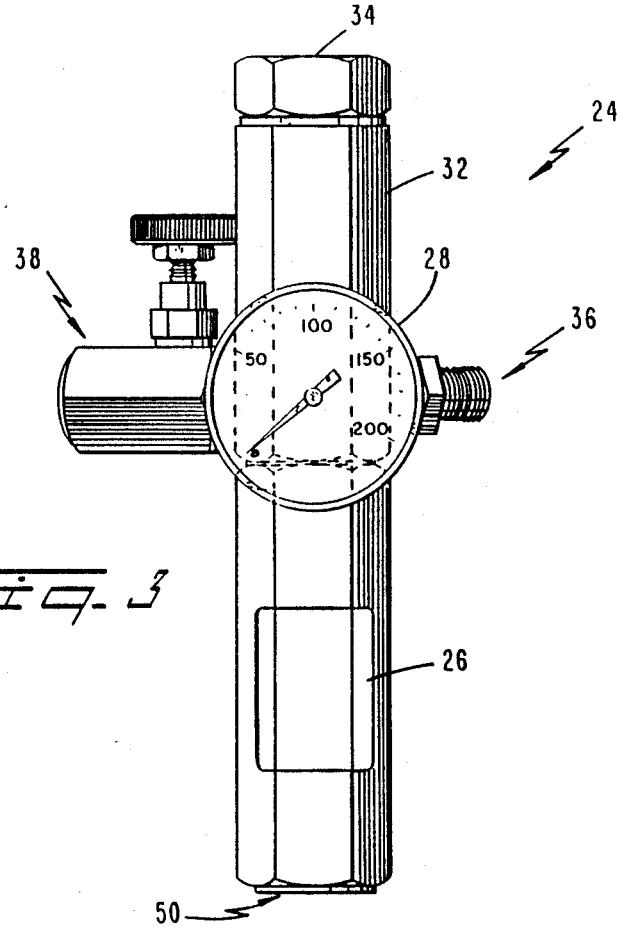
FIG. 3 is a front view of the device of FIG. 2.
Figure 4:
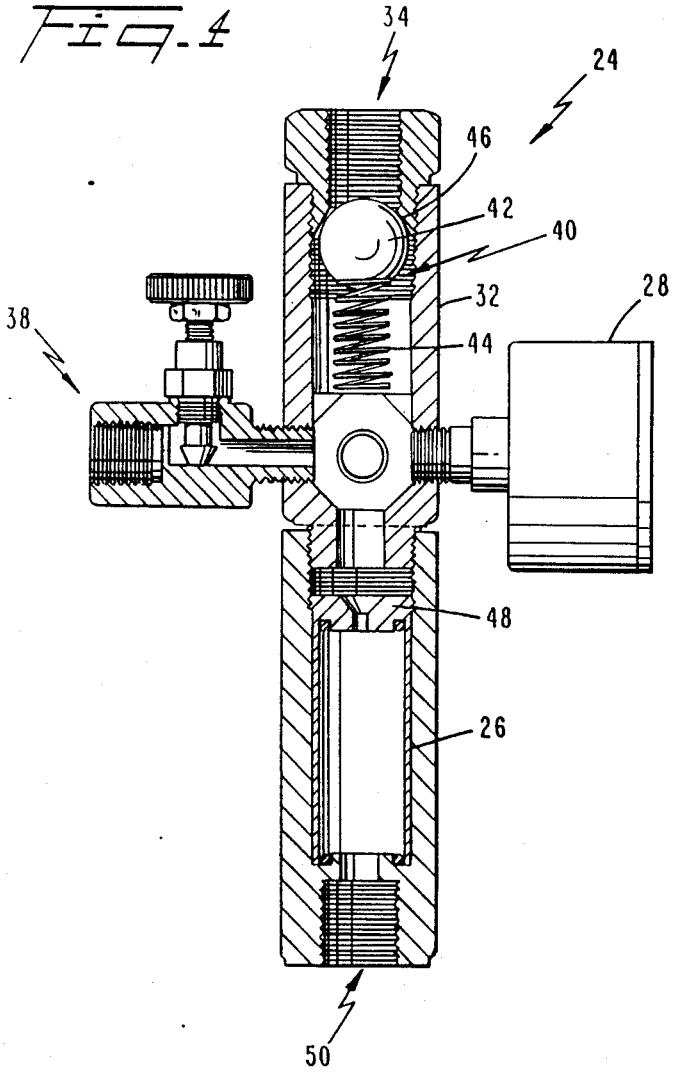
FIG. 4 is a cross-sectional view taken along lines 4—4 of FIG. 2.

With attention to FIGS. 2–4, the mixing chamber 24 includes a generally cylindrical housing 32 having an inlet 34 for receiving a flow of production oil via conduit 22 and an inlet port 36 for admitting chemicals. Chemicals typically would be pumped from a tank (not shown), at a predetermined flow rate. A bleed valve 38 is also provided. This valve can be used to take samples or can be used to relieve pressure from the slip stream is repair is necessary.

Figure 5:
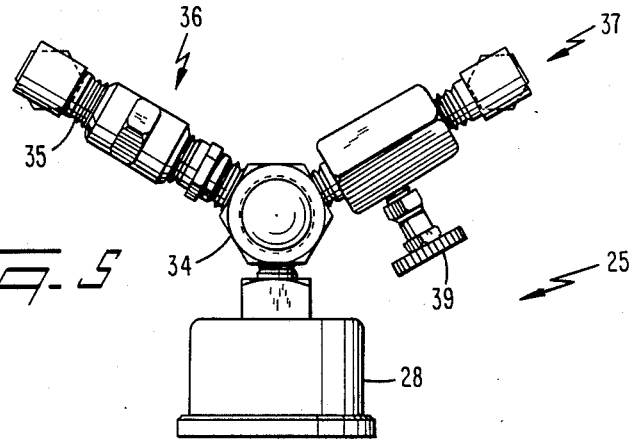
FIG. 5 is a top view of an embodiment of the mixing device of this invention.
Figure 6:
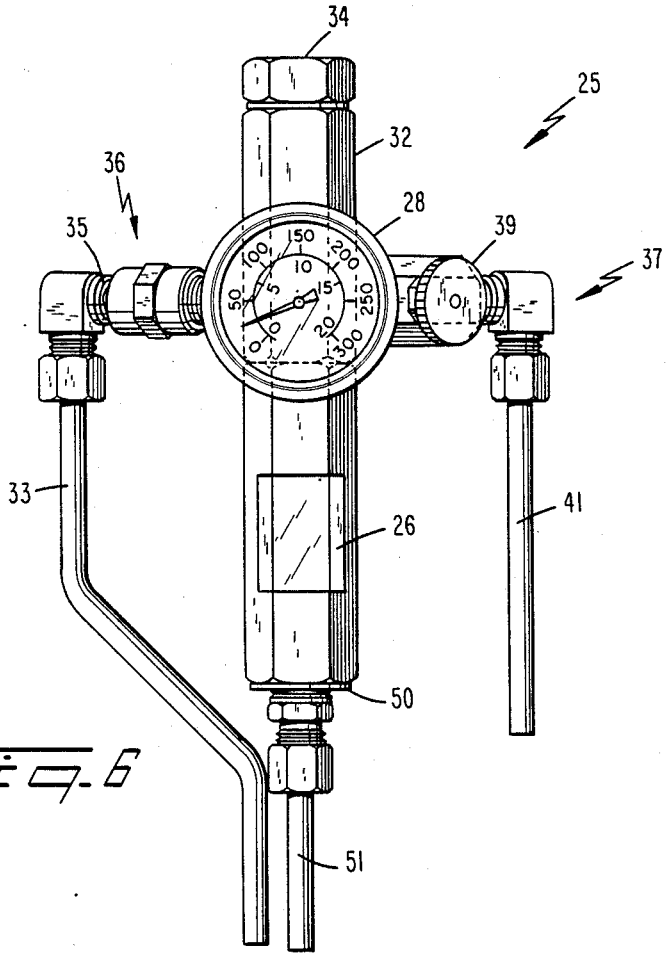
FIG. 6 is a front view of the embodiment of FIG. 5.

With attention to FIGS. 5 and 6, in this embodiment the mixing chamber 25 includes cylindrical housing 32 having an inlet 34 for receiving a flow of production oil via conduit 22 and an inlet port 36 for admitting chemicals via line 33 coupled to inlet 34 by coupling 35. A bleed valve 37 is also provided as in the embodiment of FIGS. 2–4 with an actuating knob 39 for withdrawing samples via line 41 or for relieving pressure.

A biased check valve 40 is provided immediately down stream of inlet 34. In the preferred embodiment, check valve 40 consists of a sphere 42 mounted on a spring 44. Normally the pressure of the production oil stream through inlet 34 will keep valve 40 open by depressing spring 44. However, if pressure builds downstream of the device 24 as for instance in the case of a clog in the line, the back pressure will cause valve 40 to close and seat the sphere 42 against valve seat 46. In this way, chemicals admitted through the injection port 36 will not flow upstream of the diverted production oil flow and instead will continue to build pressure downstream of the device 24 until the clog is blown through clearing the line.

Chemicals injected through port 36 normally mix with the incoming flow of production oil through inlet 34 and then flow through choke 48 which control the flow rate passed site glass 26 and throughout outlet 50 via line 51 whereupon the stream is admitted to the casing and slips down the casing as shown in FIG. 1 to the bottom of the well. The chemicals then mix with the oil produced and are pumped by down hole pump 14 upwardly, to ultimately exit the well via conduit 18.

Typically the bleed valve 38 or 39 is a ⅛ inch valve and also typically the choke 48 is replaceable depending upon the flow rate desired. As previously indicated, in a preferred embodiment of this invention, a pressure of 10 to 15 pounds per square inch over the casing pressure should be registering on pressure gauge 28 during production.

In summary, the slip stream device of this invention is intended to provide a continuous flow of chemicals flushed down the casing of a well by a diverted stream of production oil. In this way the use of trucked in chemicals such as hot oil, will be unnecessary because contaminants such as paraffin or emulsions will not be permitted to form. Therefore the overall cost of production will be substantially less. The device of this invention then includes a mixing chamber for admitting chemicals into the diverted production oil stream and for controlling the flow therethrough to a predetermined rate. Most importantly, the device of this invention includes a one way check valve whereby in the case of downstream clogging the chemicals will not back up into the production oil stream but rather will continue to build up pressure downstream of the mixing chamber as the chemicals continue to be pumped into the system until the clog is blown through. A high pressure sight glass is provided for visual inspection of the stream and a bleed valve for sampling the stream is also provided. Finally, the flow rate through the mixing chamber is controlled by a internal choke which in the preferred embodiment can be easily replaced if it is desired to change the diameter of the throat therein.

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A device for continuously adding chemicals to a production oil and gas well including a casing extending into the ground with a substantially coaxially disposed tubing therein wherein a down hole pump pumps crude oil upwardly through the tubing and gas flows upwardly through the casing, said device comprising:

an above ground mixing chamber having an inlet and an outlet;

first means communicating between said tubing and inlet for diverting a flow of production oil into the inlet;

pressure responsive valve means communicating with the inlet for closing the inlet when pressure within the chamber exceeds a predetermined value;

second means communicating with said chamber for admitting a predetermined flow of liquid chemical into said chamber; and means carried by said device for permitting only a predetermined flow rate of liquid through said chamber, conduit means communicating between the outlet and said casing for conveying the flow through the outlet into the casing;

whereby said liquid contents flush downwardly through said casing through the well to be pumped upwardly through the tubing.

2. The device of claim 1 wherein said means for permitting only a predetermined flow rate includes an orifice of predetermined diameter.

3. The device of claim 1 further comprising a sight glass on said chamber for visually observing the mixture therein.

4. The device of claim 1 further comprising pressure gauge means communicating with the interior of said chamber for registering the pressure therewithin.

5. The device of claim 1 further comprising bleed valve means in communication with the interior of said chamber for sampling the contents therewithin.

6. The device of claim 1 wherein the pressure responsive valve means comprises a biased check valve adapted to seat in the inlet when the pressure within the chamber exceeds the pressure within the said first means.

7. The device of claim 1 wherein said first means further comprises a back pressure valve adapted to control the flow of production oil diverted from said tubing to said chamber.

8. Method for continuously adding chemicals to a production oil and gas well having a casing extending into the ground with a substantially coaxially disposed tubing therein wherein a down hole pump pumps crude oil upwardly through the tubing and gas flows upwardly through the casing comprising the steps of:

providing an above ground mixing chamber having an inlet and an outlet;

diverting a predetermining flow of production oil from said tubing into the inlet to said chamber;

adding a predetermined flow of chemicals to said diverted flow of oil in said chamber while maintaining the pressure within said chamber within a predetermined range;

conveying the mixture of chemicals and oil from said chamber through the outlet therein and into said casing.

9. The method of claim 8 further comprising;

providing a sight glass on said chamber whereby the mixture therein can be visually inspected.

10. The method of claim 8 further comprising;

providing a pressure gauge in communication with the interior of said chamber for registering the pressure therewithin.

11. The method of claim 8 further comprising;

providing a bleed valve in communication with the interior of said chamber for sampling the contents thereof.

12. The method of claim 8 wherein the step of maintaining the pressure within said chamber above a lower level includes increasing the flow of oil diverted to said chamber without increasing the flow rate therethrough.

13. The method of claim 8 wherein the step of maintaining the pressure within said chamber within a predetermined range further comprises closing the inlet to a flow of production oil into said chamber, or a flow of a mixture of oil and chemicals out of said inlet when the pressure within said chamber exceeds an upper limit while adding chemicals to said chamber until the pressure within said chamber falls below an upper limit so that if the mixture of oil and chemicals flowing through the outlet becomes obstructed, chemicals will be added to the chamber increasing the pressure therein until the obstruction is removed.

* * * * *